US005081860A

United States Patent [19]

Rante

[11] Patent Number: 5,081,860

[45] Date of Patent: Jan. 21, 1992

[54] BACKLASH REDUCTION SYSTEM FOR TRANSFER FEED PRESS RAIL STANDS

[75] Inventor: Anthony Rante, Westmont, Ill.

[73] Assignee: Connell Limited Partnership, Boston, Mass.

[21] Appl. No.: 602,118

[22] Filed: Oct. 22, 1990

[51] Int. Cl.[5] ..... B21D 43/05

[52] U.S. Cl. ..... 72/405; 198/621

[58] Field of Search ..... 72/405, 421; 198/621; 414/749, 751

[56] References Cited

U.S. PATENT DOCUMENTS

| | | | |
|---|---|---|---|
| 3,422,657 | 1/1969 | Grombka | 72/421 |
| 3,988,937 | 11/1976 | Higuchi | 198/621 |
| 4,038,862 | 8/1977 | Yamashita | 72/421 |
| 4,089,205 | 5/1978 | Mizumoto et al. | 72/450 |
| 4,378,592 | 3/1983 | Heiberger et al. | 100/207 |
| 4,387,632 | 6/1983 | Heiberger | 100/45 |
| 4,408,281 | 10/1983 | Tack, Jr. et al. . | |
| 4,436,199 | 3/1984 | Baba | 72/405 |
| 4,540,087 | 9/1985 | Mizumoto | 198/621 |
| 4,593,547 | 6/1986 | Heiberger | 72/19 |
| 4,621,516 | 11/1986 | Schafer et al. | 72/405 |
| 4,630,461 | 12/1986 | Votava | 72/405 |
| 4,651,866 | 3/1987 | Imanishi | 72/405 |
| 4,653,311 | 3/1987 | Tack, Jr. | 72/405 |
| 4,693,361 | 9/1987 | Baba | 72/405 |
| 4,785,657 | 11/1988 | Votava | 72/405 |

FOREIGN PATENT DOCUMENTS

| | | | |
|---|---|---|---|
| 283426 | 12/1986 | Japan | 72/405 |

*Primary Examiner*—Daniel C. Crane
*Attorney, Agent, or Firm*—Leydig, Voit & Mayer

[57] ABSTRACT

A system for reducing looseness and backlash generally associated with transfer feed press feed systems that includes a driven tensioning device that exerts continuous tension on the drive system to ensure positive, slip-free meshing of the drive components. The tensioning device includes a tensioning sprocket that is coupled to a sprocket of the driven system by a chain or the like. An actuator positions the tensioning sprocket to maintain tension on the chain, and, therefore, the drive system. An additional tensioning device, such as a spring-biased sprocket, is also positioned against the chain to prevent any looseness from developing during operation.

12 Claims, 10 Drawing Sheets

BACKLASH REDUCTION SYSTEM FOR TRANSFER FEED PRESS RAIL STANDS

TECHNICAL FIELD

The present invention relates generally to transfer feed presses, and, more particularly, to an apparatus for controlling the backlash and bounce of the transfer feed rails during operation.

BACKGROUND OF THE INVENTION

Transfer feed presses are well known in the metal working industry. While they vary in size, and output, depending on the manufacturer's specific needs, they typically have certain common components. In general, a transfer feed press is a machine having a plurality of successive work stations wherein work pieces are pressed to form a variety of products. The transfer feed press typically uses pairs of transfer feed rails for transporting work pieces through the successive stations as well as into and out of the machine. In a tri-axis type feed, these transfer rails are reciprocated longitudinally, transversely, and vertically in order to achieve the transport of the work pieces.

Reciprocation of the transfer feed rails may be achieved by a number of methods known in the art, such as cam drive systems that translate motion to the rail either directly or by the use of gear systems. Although precise movement of the rails is necessary in order to produce quality products, the cumulation of the tolerances of the components of the driving mechanism may result in undesirable, imprecise movement in the form of bounce of the transfer feed rails. Although the problem has been reduced somewhat in conjugate camming systems, and through the use of a number of devices, these design changes and devices have generally been inadequate to ensure positive, slip-free meshing of the gears at high speeds.

SUMMARY OF THE INVENTION

The invention provides a system for reducing the looseness and backlash generally associated with feed systems of transfer feed presses. A driven tensioning device exerts constant tension on the drive system to ensure positive, slip-free meshing of the drive components. The tensioning device includes a tensioning driven member that is coupled to a driving member of the drive system such as by a chain and sprockets arrangement, or the like. In a chain and sprocket arrangement, a rotary actuator positions the tensioning sprocket to maintain tension on the chain, and, therefore, the drive system. An additional tensioning device, such as a spring-biased sprocket, is also positioned against the chain to prevent any looseness from developing during operation.

OBJECTS OF THE INVENTION

It is a primary object of the present invention to provide a transfer feed press having an improved workpiece transfer system in which the transfer feed rails consistently, accurately, and reliability move a plurality of workpieces from one press operation to another during high speed production runs.

A related object is to provide a workpiece transfer system with reduced bounce and backlash in the transfer feed rails.

Another object of the invention is to provide a transfer system with minimal looseness and slop in the components of the drive system.

A further object is to provide a workpiece transfer system that automatically maintains or is easily adjustable to maintain positive, slip-free meshing of the drive components.

Yet another object is to provide a device that may be coupled to the drive components of a transfer feed system to accomplish the objects set forth above.

Other objects and advantages of the invention will become apparent upon reading the attached detailed description and upon reference to the drawings, in which:

DESCRIPTION OF THE PREFERRED EMBODIMENT

While the invention will be described in connection with certain preferred embodiments, it will be understood that it is not intended to limit the invention to these particular embodiments. On the contrary, it is intended to cover all alternatives, modifications, and equivalents included within the spirit and scope of the invention as defined by the appended claims.

Figure 1:
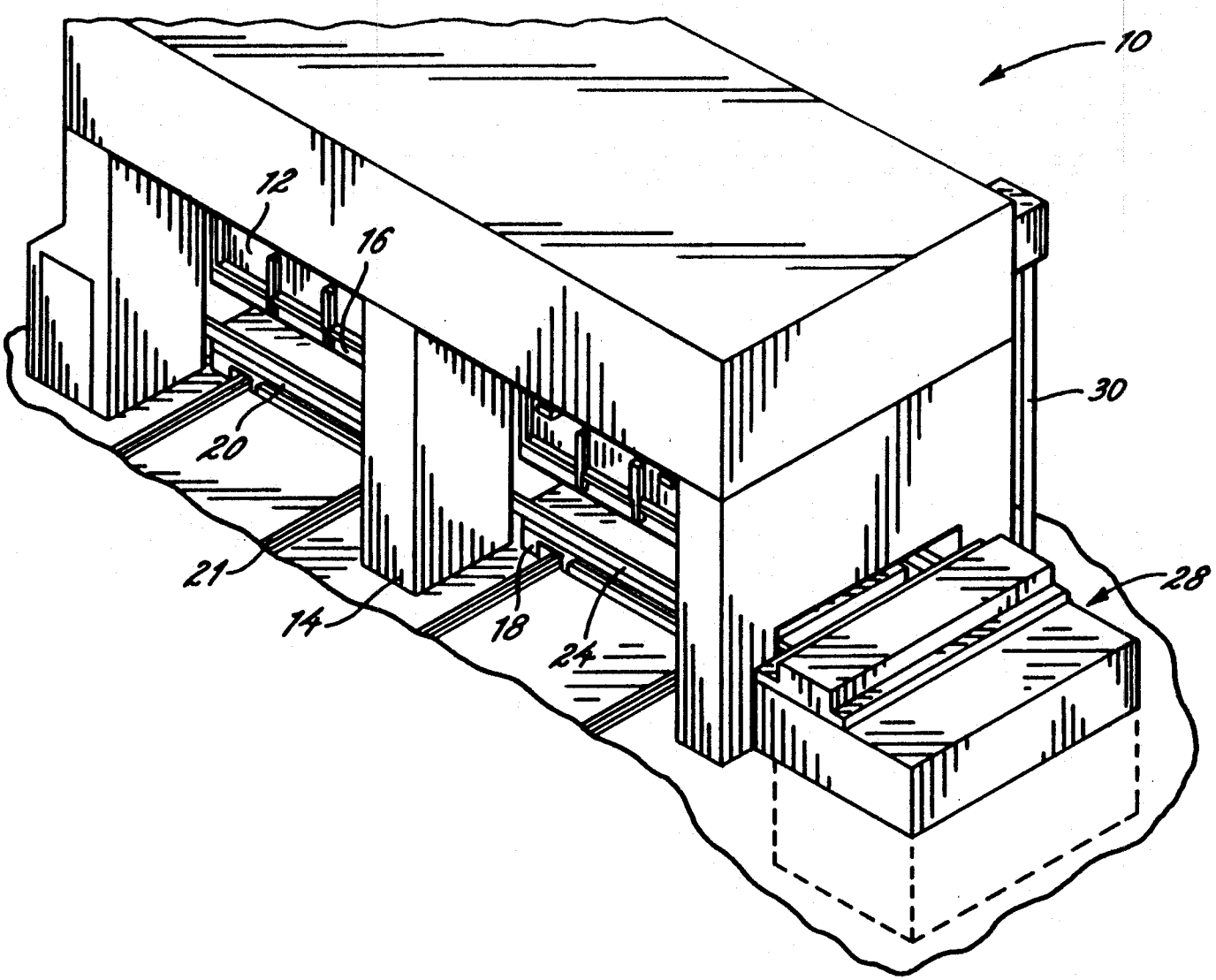
FIG. 1 is a perspective view of a dual slide transfer feed press.

Turning now to the drawings and referring first to FIG. 1, there is shown a transfer feed dual slide press 10 having vertically movable slides 12, which are supportably guided by a plurality of columns 14. While the invention will be described with reference to a dual unit press 10, it will be appreciated that the invention is likewise applicable to a press having only a single unit, or a synchronized line of presses. The slide 12 carries the upper half of the die 16, and a bolster 18 supports the lower half of the die 20. The bolster 18 may be moved transversely in and out of the press slide region by means of motorized wheels (not shown) and tracks 21 and as described in detail in the copending U.S. application of Eugene V. Ostor entitled "ELECTRONIC BRAKING SYSTEM FOR POWER PRESS DIE CHANGE CARRIERS," Ser. No. 601,338, filed Oct. 22, 1990. In working operation, the slide 12 carrying the upper half of the die 16 is reciprocated vertically through a full cycle by a conventional motor drive mechanism (not shown) such that the upper half of the die 16 and the stationary lower half of the die 20 are alternately brought into and out of contact.

At least one set of transfer feed rails 24, 26 extends longitudinally through the transfer feed press 10 and is used to transport workpieces through successive work stations in the press 10. To accomplish this workpiece movement, the transfer feed rails 24, 26 are reciprocated longitudinally, transversely, and vertically by a tri-axial transfer drive (shown generally as 28), which may be powered by a power take-off shaft 30 of the motor drive mechanism. The transfer drive 28 may be of any design that provides tri-axial movement of the rails 24, 26, such as the "TRANSFER FEED MECHANISM FOR POWER PRESSES" disclosed in U.S. Pat. No. 4,630,461 to Votava, which issued Dec. 23, 1986. As is well known and conventional in the art, spring-loaded finger units (not shown) may be attached to the transfer feed rails 24, 26 for actually handling the workpieces.

Figure 2:
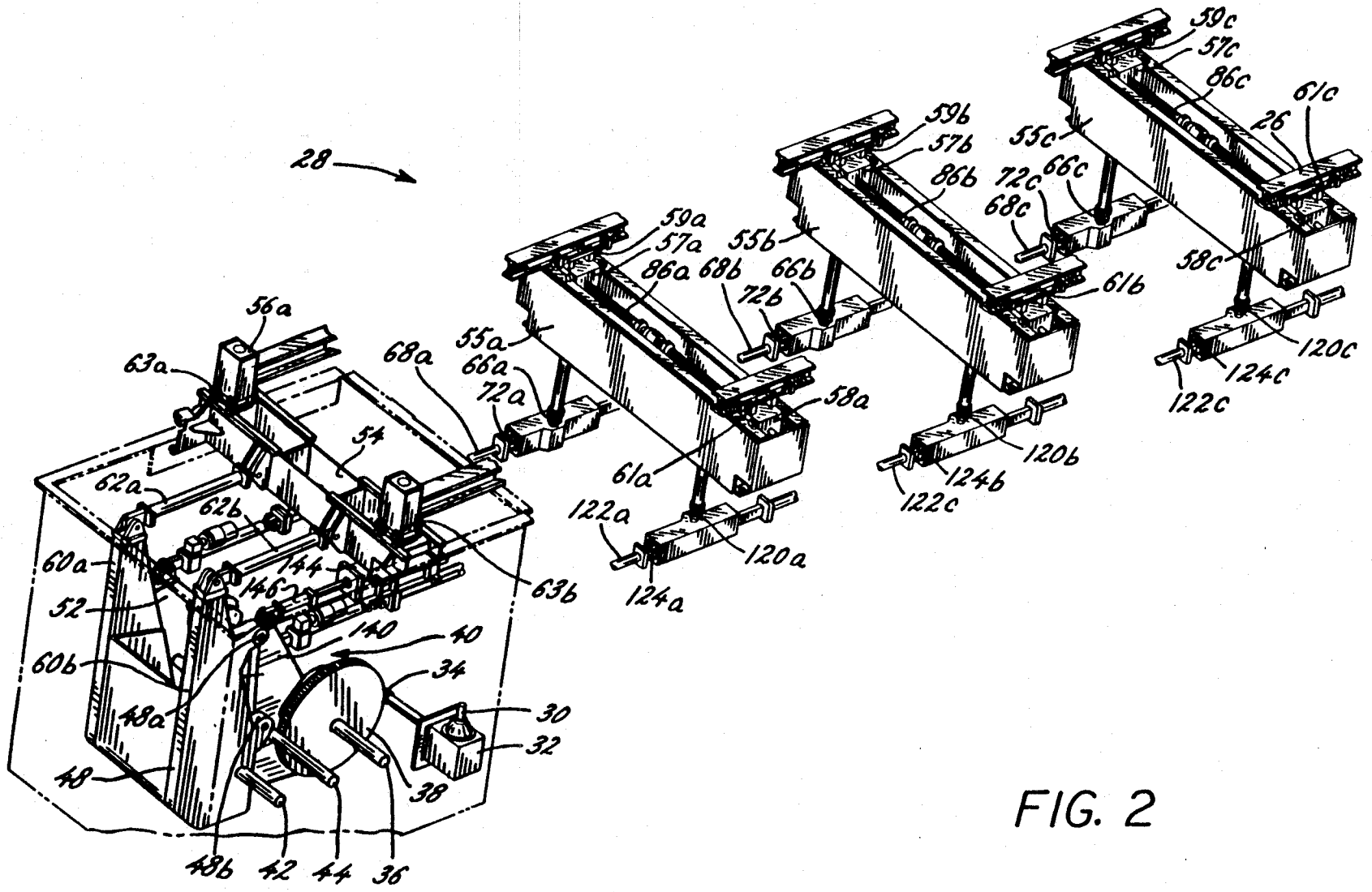
FIG. 2 is a partially fragmented, isometric view of the transfer feed mechanism of the transfer feed press shown in FIG. 1.
Figure 3:
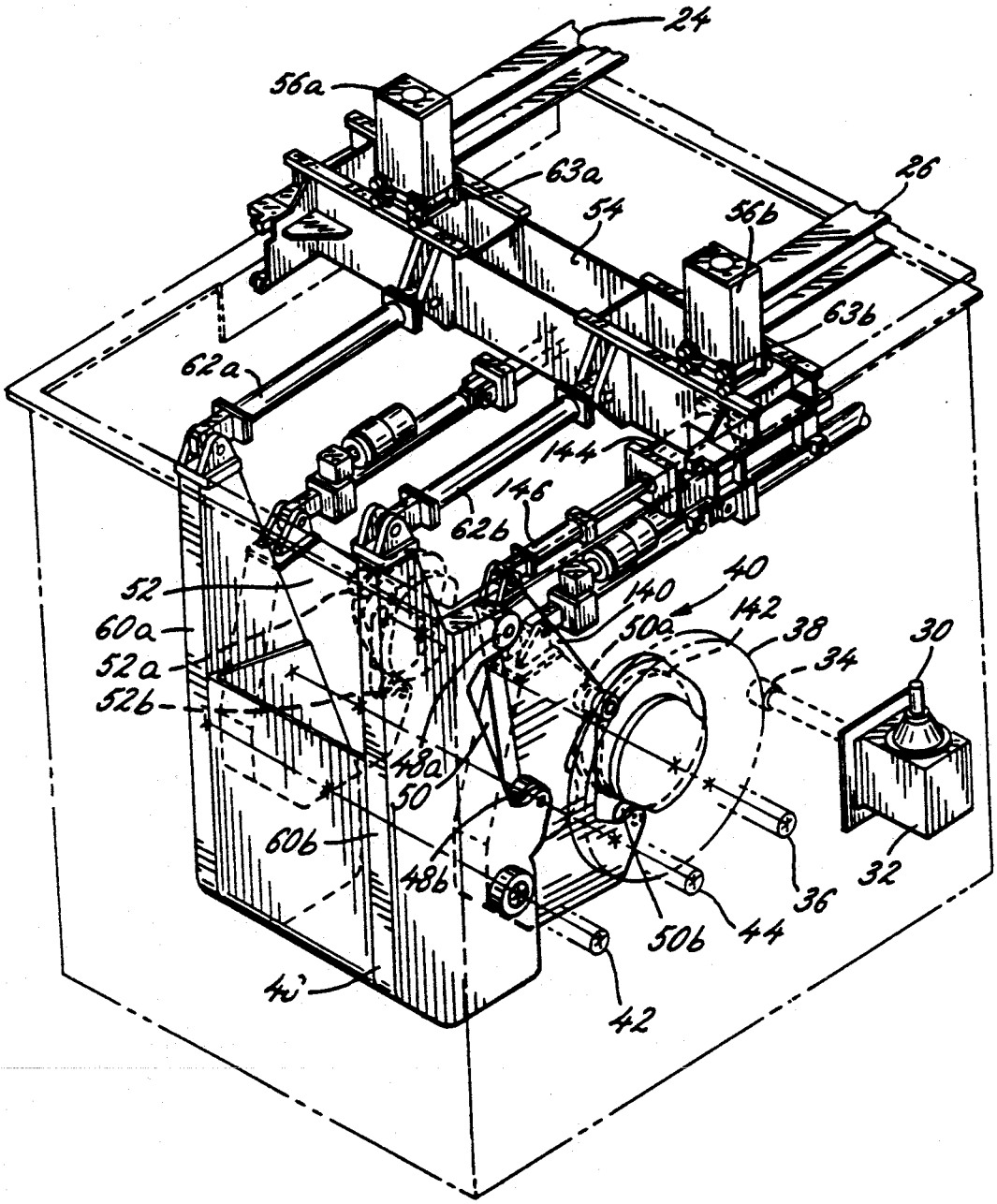
FIG. 3 is a partially fragmented, enlarged view of the cam system and longitudinal stroke drive mechanism shown in FIG. 2.

A suitable tri-axial transfer drive 28 including parallel transfer feed rails 24, 26 is shown in more detail in FIG. 2. The drive, a portion of which is shown in greater detail in FIG. 3, is composed generally of a system of cams and rocker arms that control the movement of the rails 24, 26 in the directions along the three axes. The power take-off shaft 30 is connected to the input side of a differential gear mechanism 32, which drives a pinion gear 34. The differential gear mechanism 32 may be provided with a separate auxiliary motor (not shown), which operates independently of the power take-off shaft 30 and may be used to run the transfer feed mechanism when activated.

Mounted on the cam shaft 36 is a bull (or main drive) gear 38, which is driven by the pinion gear 34, and a cam set (shown generally as 40). The individual cam surfaces of the cam set 40 are computer-designed to provide the rails 24, 26 with predetermined longitudinal-stroke, transverse-stroke, and vertical-stroke dimensions.

Longitudinally spaced from the cam shaft 36 are fixed, transversely disposed rocker arm shafts 42, 44. A channel-type longitudinal stroke rocker arm assembly 48 is mounted on the rocker arm shaft 42; a transverse stroke rocker arm assembly 50 and a vertical stroke rocker arm assembly 52 are mounted on the rocker arm shaft 44 and are each independently pivotable about the shaft 44 axis. Each of the rocker arms 48, 50, 52 has a pair of respective cam followers **48*a*, 48*b*, 50*a*, 50*b*, 52*a*, 52*b* that ride on respective conjugate cam surfaces of the cam set 40. Each of the conjugate cam surfaces controls movement of the feed mechanism and, therefore, the transfer feed rails 24, 26** in one direction along one of the three axes, thereby insuring a positive drive in both directions along each of the three axes.

In order to support the transfer feed rails 24, 26, a sliding support member 54 is provided. Also provided are support members **55*a*, 55*b*, 55*c*, which house portions of the vertical stroke and transverse stroke assemblies. While three stationary support members 55*a*, 55*b*, 55*c* are shown in the embodiment in FIG. 2, it will be appreciated that any number of support members 55 may be provided. The rails 24, 26 are movably coupled to the sliding support member 54 by trolleys 56*a*, 56*b* that permit lateral and vertical movement of the rails with respect to the member 54. In a similar manner, trolleys 57*a*, 57*b*, 57*c*, 58*a*, 58*b*, 58*c* movably couple the rails 24, 26 to the stationary support members 55; in addition in allowing lateral and vertical movement of the rails 24, 26, the trolleys 57, 58 permit longitudinal movement of the rails 24, 26 with respect to the stationary support members 55. As the tri-axial movement of the rails 24, 26 is accomplished by three separate cam and rocker arm assembles, specific operation of the trolleys 56, 57, 58** will be further explained with reference the three assemblies.

The longitudinal movement of the rails 24, 26 is provided by a channel-type design rocker arm assembly 48 and a cam set. (In order to simplify the illustrations, the longitudinal stroke cam is not illustrated in FIGS. 2 and 3.) The rocker arm assembly 48 includes a pair of spaced apart vertical arms **60*a*, 60*b*, and a pair of cam followers 48*a*, 48*b*. The cam followers 48*a*, 48*b* follow the edge of the cam (not shown) to pivot the rocker arm assembly 48 about the rocker arm shaft 42. Elongated connecting members 62*a*, 62*b* couple the vertical arms 60*a*, 60*b* of the longitudinal stroke rocker arm assembly 48 to a transversely disposed sliding support member 54. The transfer feed rails 24, 26 are carried on the support member 54 by the trolleys 56*a*, 56*b*. Thus, as the rocker arm 48 pivots, the support member 54 slides along structure (not shown) to effect the longitudinal stroke of the transfer feed rails 24, 26. The wide spacing of the connecting members 62*a*, 62*b* along the support member 54 ensures that the support member 54 moves evenly along the structure (not shown). This results in smooth longitudinal movement of the rails 24, 26**.

The trolleys **56*a*, 56*b* permit movement of the rails 24, 26 transversely and vertically, but not longitudinally, with respect to the sliding support member 54. The trolleys 56*a*, 56*b* are free to move transversely via rollers 63*a*, 63*b*. Similarly, the rails 24, 26 are free to move vertically within the trolleys 56*a*, 56*b* via a roller mechanism (not shown) contained within each trolley 56*a*, 56*b***.

Figure 4A:
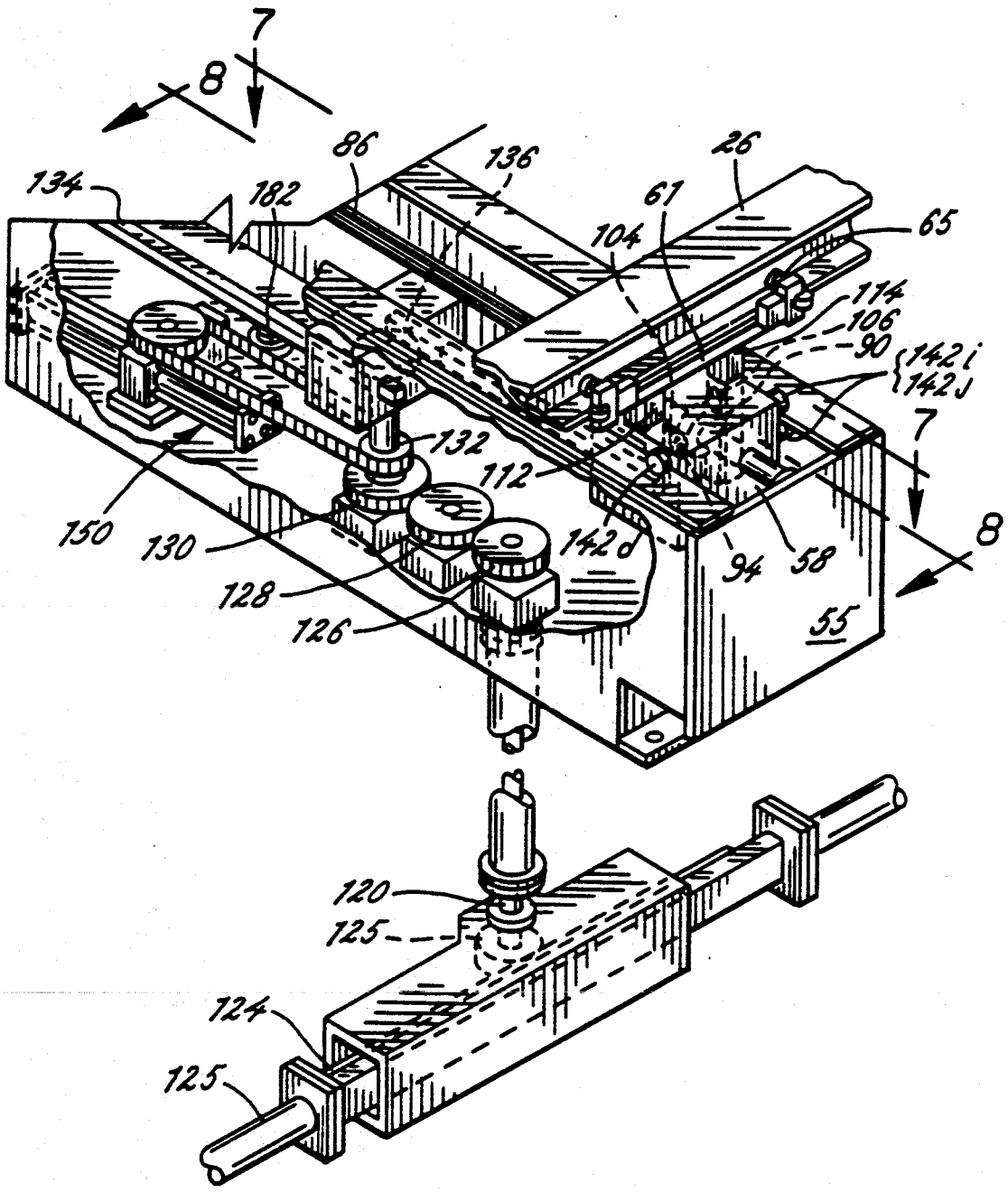
FIG. 4A is a partially fragmented, enlarged view of the portion of the transfer feed mechanism associated with the right side of a single transversely disposed support member shown in FIG. 2.
Figure 4B:
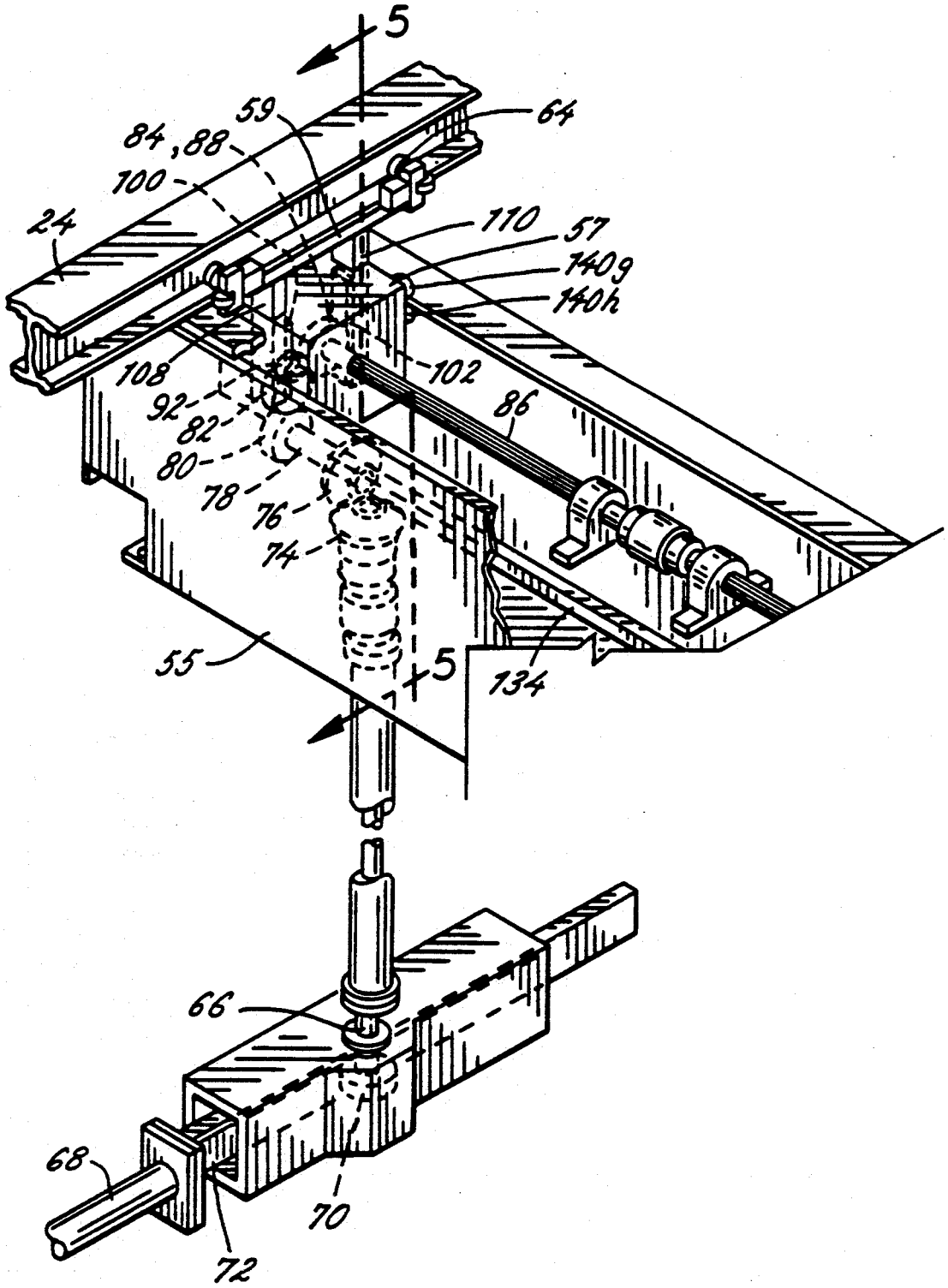
FIG. 4B is a partially fragmented, enlarged view of the portion of the transfer feed mechanism associated with the left side of a single transversely disposed support member shown in FIG. 2.

The transfer feed mechanisms associated with the stationary support members **55*a*, 55*b*, 55*c* are identical for all practical purposes. Therefore, the details of the mechanisms will be described with respect to a single support member 55, as are shown in FIGS. 4A and 4B (components are designated generally without a letter suffix). In the embodiment shown, similar components are provided for each such support member 55*a*, 55*b*, 55*c*** illustrated in FIG. 2.

Figure 8:
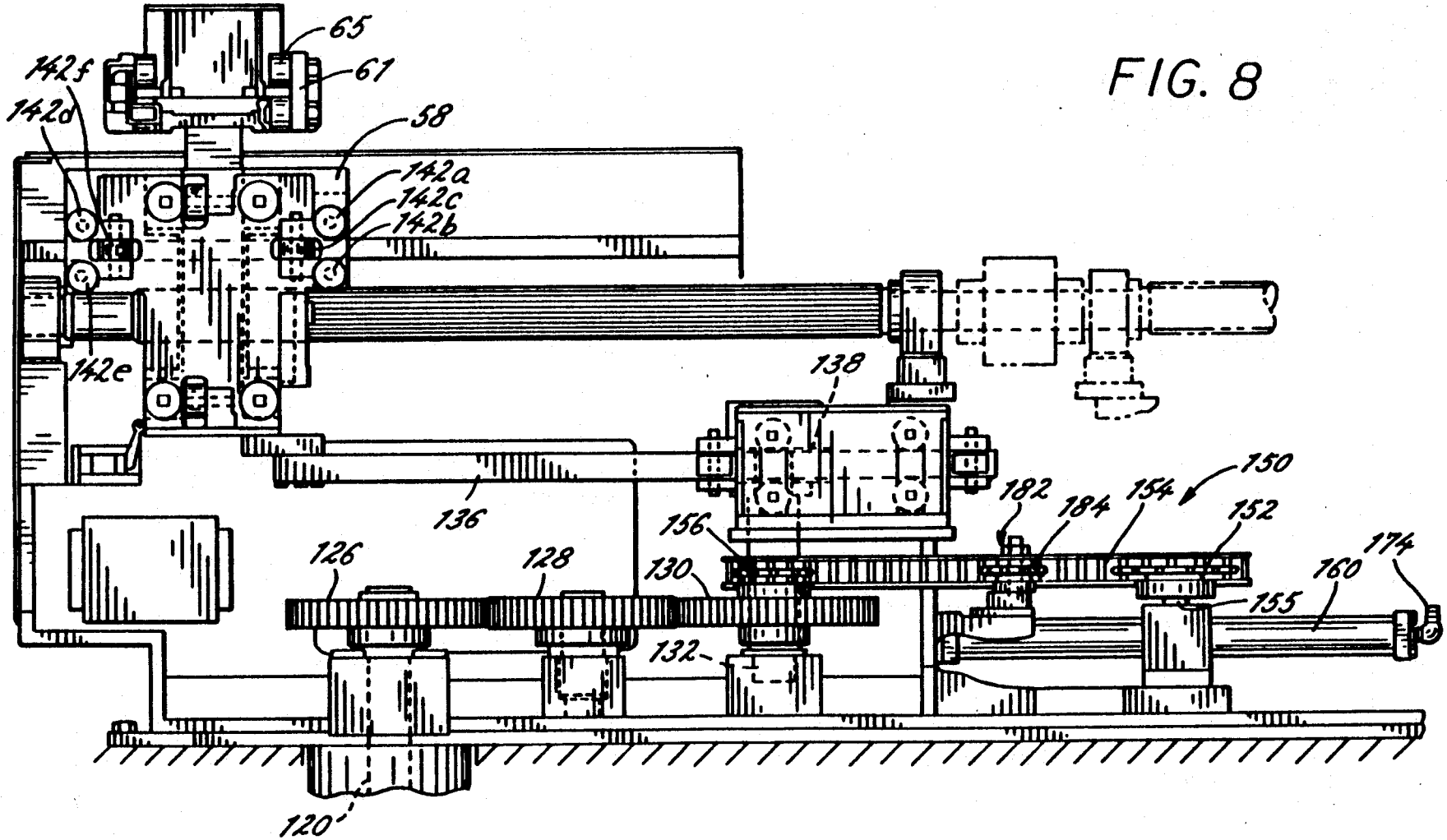
FIG. 8 is a partially fragmented side view of the lateral stroke drive mechanism taken along line 8—8 in FIG. 4A.

As the rails 24, 26 are moved in the transverse direction by the rocker arm 50 and cam assembly, the rails 24, 26 move transversely with respect to the stationary support members 55. To permit this transverse movement, the trolleys 57, 58 are provided with rail carriers 59, 61, which support rollers 64, disposed along the top, bottom and side of the rails 24, 26. The rollers 64, 65 allow the rails 24, 26 to roll along the rail carriers 59, 61, and, therefore, the trolleys 57, 58, as shown in FIGS. 2, 5, and 8.

Returning now to FIG. 2, in order to provide vertical movement of the rails 24, 26, the invention provides three vertically disposed, longitudinally spaced, rotatable shafts **66*a*, 66*b*, 66*c*** that are coupled to the vertical stroke rocker arm assembly 52 by way of an elongated connecting member 68a, 68b, 68c, which may be constructed in multiple segments. So that the rails 24, 26 remain horizontally disposed as they move vertically, the shafts 66a, 66b, 66c are arranged in a manner so as to be rotated in synchronization through operation of the rocker arm 52. Mounted at the lower end of each shaft 66a, 66b, 66c is a respective pinion gear 70 (shown in FIG. 4). Rack gears 72a, 72b, 72c are disposed along the elongated connecting member 68a, 68b, 68c to respectively mesh with the pinion gears 70. The elongated connecting member 68a, 68b, 68c is coupled to the vertical stroke rocker arm assembly 52 such that movement of the rocker arm assembly 52 results in synchronous rotation of the shafts 66a, 66b, 66c through longitudinal movement of the rack gears 72a, 72b, 732c.

Figure 5:
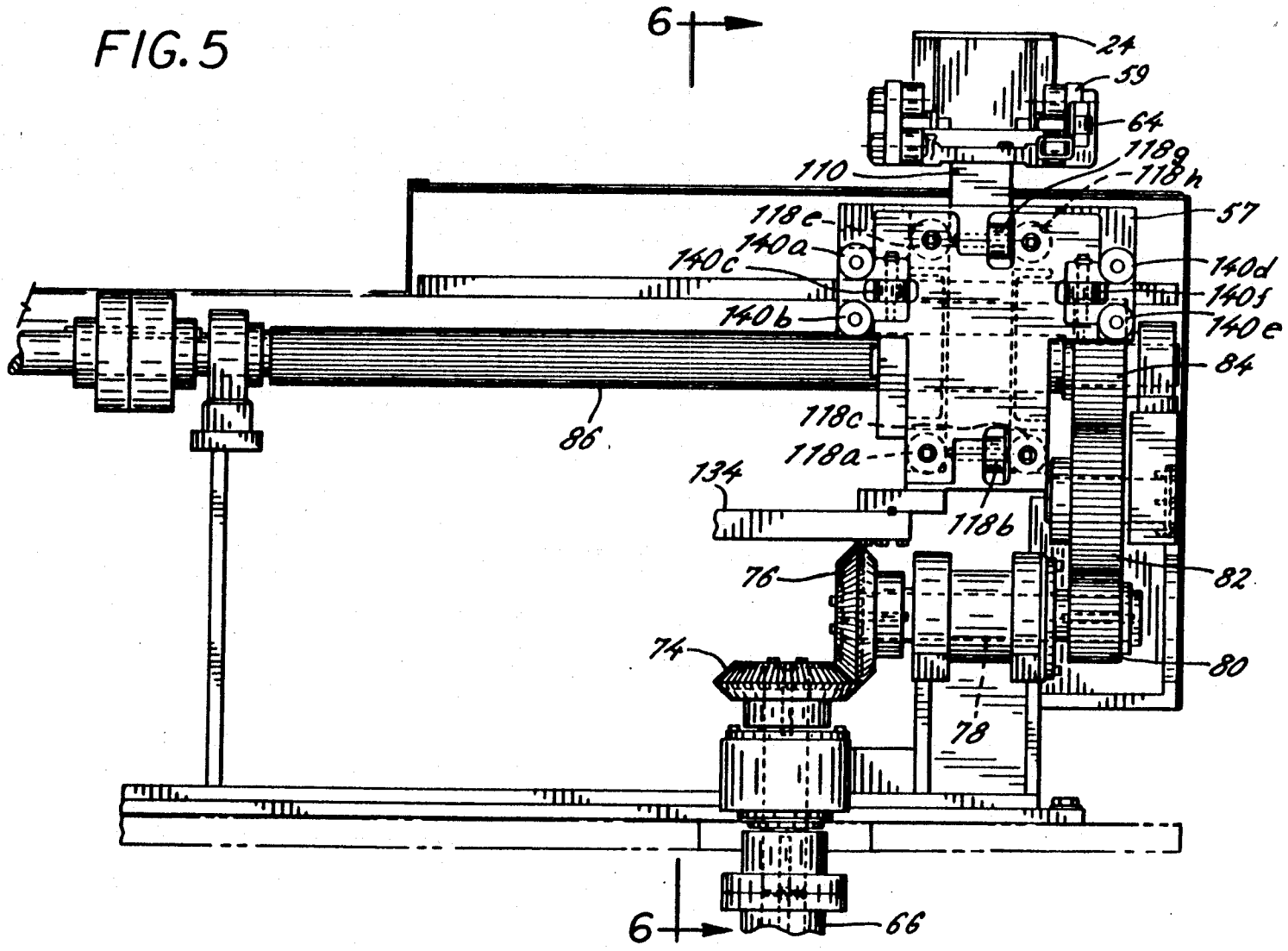
FIG. 5 is a partially fragmented side section elevation of the vertical stroke drive mechanism taken along line 5—5 in FIG. 4B.
Figure 6:
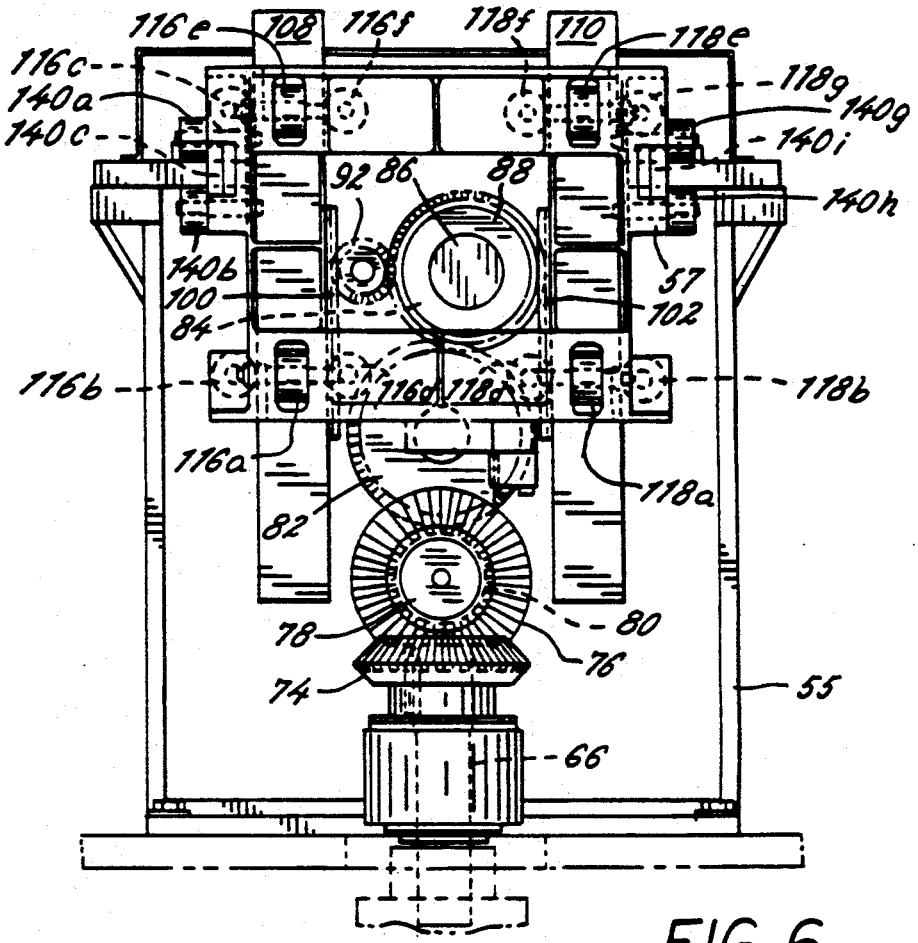
FIG. 6 is a partially fragmented plan view of the vertical stroke drive mechanism taken along line 6—6 in FIG. 5.
Figure 7:
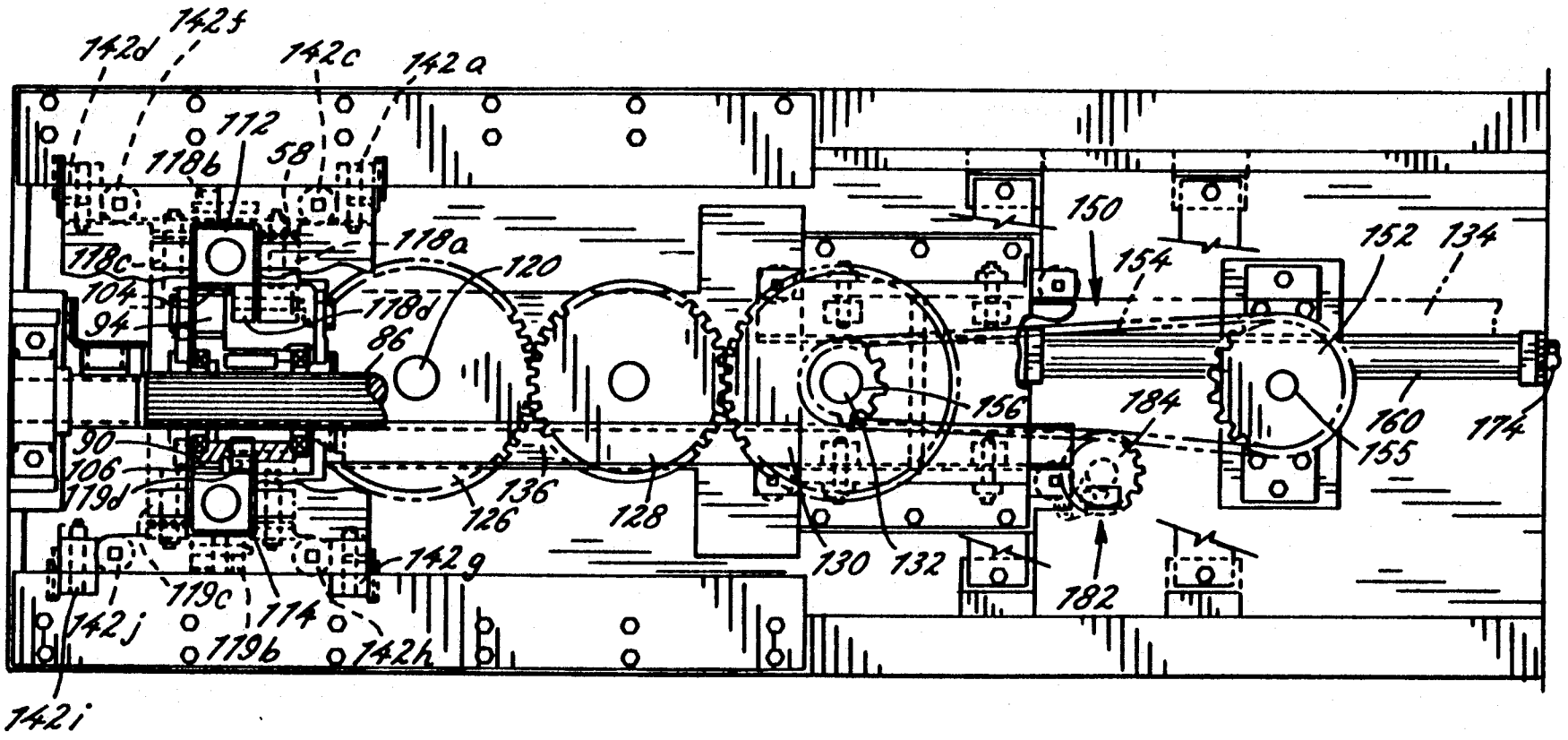
FIG. 7 is a partially fragmented top view of the lateral stroke drive and vertical stroke drive mechanism taken along line 7—7 in FIG. 4A.

Further operation of the vertical stroke mechanism will be explained with reference to the single support member 55 illustrated in FIG. 4B (the side, plan and top views of which are shown in FIGS. 5, 6, and 7, respectively). The motion of the vertical stroke rocker arm assembly 52 is further translated by bevel gear 74 mounted to the shaft 66. The bevel gear 74 engages a second bevel gear 76, which is coupled by a shaft 78 to gear 80, idler gear 82 and pinion gear 84, which is disposed on a rototable spline shaft 86.

Rotation of the spline shaft 86 is translated into vertical movement of the rails 24 26 by way of rack and pinion gears disposed within the trolleys 57, 58. As best seen in FIGS. 4A, 4B, 6, and 7, pinion gears 88, 90, which are located at opposite ends of the spline shaft 86, are disposed on the trolleys 57, 58, and are mounted to rotate with the spline shaft 86. The pinion gears 88, 90, mesh with idler gears 92, 94, respectively. In order to impart vertical movement to the rails 24, 26, vertically disposed rack gears 100, 102, 104, 106, which are disposed on rams 108, 110, 112, 114, are provided. Pinion gears 88, 90 mesh with rack gears 102, 106, respectively, and idler gears 92, 94 mesh with rack gears 100, 104, respectively, to impart smooth vertical movement to the rams 108, 110, 112, 114. The path of rams 108, 110, 112, 114 is defined by rollers 116a–116f, 117a–117h, 118a–118d, 119a–119d disposed in trollys 57 and 58. It will be appreciated that all of the rollers are not shown in each view. The rail carriers 59, 61 are disposed on the upper ends of rams 108, 110, 112, 114. As previously described, the rollers 64, 65 disposed on the rail carriers 59, 61 define the lateral path of the rails 24, 26. In this way, actuation of the vertical stroke rocker arm assembly 52 synchronistically raises or lowers the rails 24, 26 to effect a lift stroke as the pinion gears 88, 90 and idler gears 92, 94 engage rack gears 100, 102, 104, 106.

Returning now to FIG. 2, to provide the transverse stroke, three vertically disposed, longitudinally spaced rotatable shafts 120a, 120b, 120c are controlled by the operation of the transverse stroke rocker arm assembly 50. This is accomplished through an elongated connecting member 122a, 122b, 122c, which may be of a segmented design, having rack gears 124a, 124b, 124c disposed at intervals to mesh with pinion gears 125 (shown in FIG. 4A) mounted on the lower end portion of the shafts 120a, 120b, 120c. In this way, movement of the transverse stroke rocker arm assembly 50 and the elongated connecting member 122a, 122b, 122c coupled thereto, results in synchronous rotation of the shafts 120a, 120b, 120c.

Further operation of the transverse stroke mechanism will be explained with reference to the single support member 55 illustrated in FIG. 4A, the top and side views of which are shown in FIGS. 7 and 8, respectively. Mounted at the upper end of the shaft 120 is a gear 126. The gear 126 meshes with a gear train comprising an idler gear 128 and gear 130 mounted to the lower portion of the shaft 132. In order to provide transverse movement of the rails 24, 26, rack gear-set elements 134 and 136 are coupled to the trolleys 57, 58, respectively. The first and second rack gear-set elements 134 and 136 meshably engage a pinion gear 138 mounted to the upper end of the shaft 132, as shown in FIG. 8. As the shaft 132 and the coupled pinion gear 138 rotate, the meshing rack gears 134, 136 exert a force in the transverse direction to cause the trolleys 57, 58 to move in a path defined by rollers 140a–140i, 142a–14k, and spline shaft 86, transversely along the stationary support member 55 to cause the rails 24, 26 supported on the rail carriers 59, 61 to be spaced apart or drawn together.

It will be appreciated that as the trolleys 57, 58 move laterally along the stationary support 55 and the spline shaft 86, the pinion gears 88, 90 likewise move along the spine shaft 86, continuing to mesh with the teeth of the spline shaft 86. In this way, rotation of the spline shaft 86 will rotate the pinion gears 88, 90 and the idler gears 92, 94 to raise and lower the rails 24, 26 when the trolley is located at substantially any lateral position along the support member 55.

According to an important aspect of the invention, inconsistent and erratic movement of the rails will be minimized. In ,order to ensure smooth rotation of the cam shaft 36, the invention provides a torque equalization assembly shown in FIGS. 2 and 3, which includes a rocker arm assembly 140 pivotably mounted on the shaft 44 and a cam 142 (shown in FIG. 3) secured to the cam shaft 36. A cam follower 140a follows the surface of the cam 142 as the rocker arm assembly 140 pivots about the shaft 44 axis. To stabilize the rotation of the cam shaft 36, a damping device 144 secured to a stationary surface is coupled to rocker arm assembly 140 by a connecting member 146. During operation, the force exerted on the cam 142 surface by the cam follower 140a causes the shaft 44 to rotate at a constant speed rather than "jumping"0 in response to the variable forces exerted on the other cams by the longitudinal stroke rocker arm assembly 48, the transverse stroke rocker arm assembly 50, and the vertical rocker arm assembly 52. Thus, it will be appreciated that incorporation of the torque equalizing assembly minimizes the inconsistencies in the tri-axial transfer drive 28 due to the cam system.

As explained above, rotation of the cam set on the cam shaft 36 ultimately results in movement of the rails 24, 26 along a predetermined path as the motion of the rocker arm assemblies 48, 50, 52 is translated into movement of the rails 24, 26 in the longitudinal, transverse, and vertical directions, respectively. In tri-axial drive systems 28, manufacturing tolerances of the various components of the system generally result in a certain amount of looseness or slop between the components. These accumulated clearances and tolerances may ultimately result in bounce, or in imprecise movement of the rails 24, 26 during operation.

Figure 9:
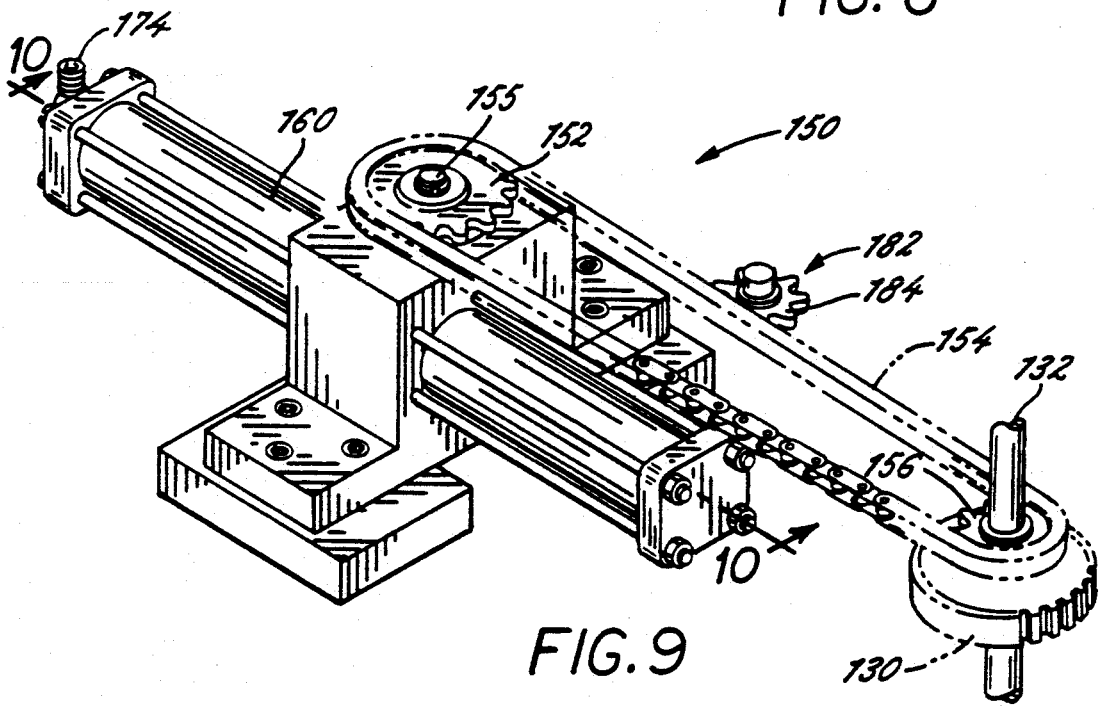
FIG. 9 is a perspective view of the tensioning device shown in FIG. 4A.
Figure 10:
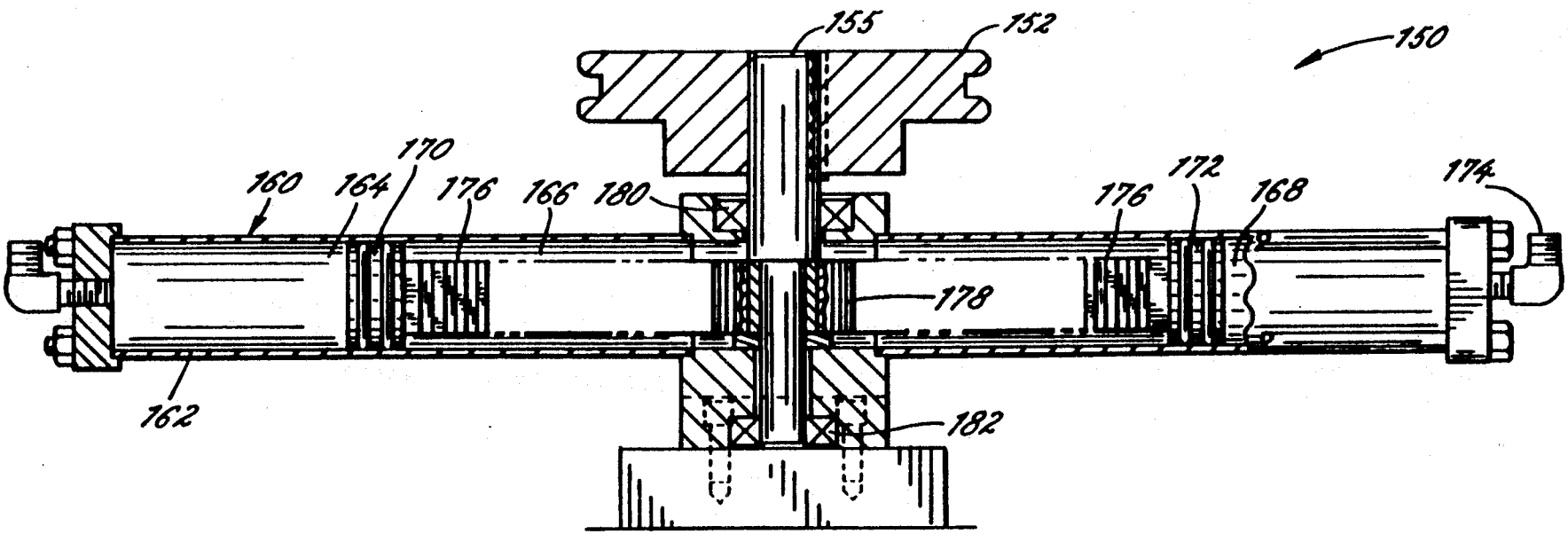
FIG. 10 is a partial sectional view of the tensioning device taken along line 10—10 in FIG. 9.

According to an important aspect of the invention, a mechanism is provided by which tension may be maintained between the rack and pinion gears to result in smooth movement of the rails 24, 26. While the invention is illustrated and explained with reference to the transverse stroke drive assembly, it will be appreciated that a similar tensioning mechanism may be utilized in connection with the vertical stroke drive assembly. Although a tensioning mechanism is provided for each of the shafts 132 in the preferred embodiment, the mechanism will be described with reference to a single shaft 132, and the associated components, as illustrated in FIGS. 4A, 7 and 8 and shown in more detail in FIGS. 9–10.

Turing to FIGS. 4A and 7, in order to control the meshing of the pinion gear 138 with the rack gear set 134, 136, a tensioning assembly (shown generally as 150) is coupled to the shaft 132. The tensioning assembly 150 includes a sprocket 152, which is coupled to the shaft 132 by a tensioning means, such as a chain, belt, or like device 154. The chain 154 is disposed about eh tensioning sprocket 152, which is disposed on shaft 155, and a sprocket 156 disposed on the shaft 132 of the lateral stroke drive mechanism.

To properly locate the tensioning sprocket 152 to exert and maintain a tension force on the sprocket 156, and therefore, the shaft 132, the assembly 150 is provided with an actuator 160. As shown in more detail in FIG. 10, the actuator 160 includes a cylinder 162, which is separated into three chambers 164, 166, 168 by movable pistons 170, 172. The outward chambers 164, 168 are charged through valve 174 with a liquid, such as hydraulic oil, under pressure. In a preferred embodiment of the invention, the chambers 164, 168 are initial preset to approximately 600 psi. The central chamber 166 contains a rack gear 176 and a pinion gear 178. The rack gear 176,. which is disposed between the pistons 170, 172, meshes with pinion gear 178 rotatably disposed on shaft 155, which is supported by bearings 180, 182. In this way, the actuator 160 positions the tension sprocket 152 disposed on shaft 155 to maintain constant tension on the chain 154.

To eliminate any slack that may develop in the chain 154 during operation of the transfer drive system 28, the tension assembly further includes an additional tension device 182, such as a universal drive tensioner. In a preferred embodiment, the tension device 182 includes a spring biased sprocket 184 disposed against the chain 154. During operation of the drive assembly, the sprocket 154 and the tension device 182 exert continual force on the chain 154, and, therefore, the shaft 132, to ensure smooth operation of the drive assembly. As the transverse stroke assembly operates to move the rails 24, 26 either inward or outward, th. tensioning assembly 150 biases the stroke assembly in the opposite direction such that it steadies the shaft 132 and the meshing of the pinion gear 138 in the rack gear-set 134, 136. It will be further appreciated that as the chain 154 maintains tension on the shaft 132, this tension will be maintained throughout the transverse stroke drive assembly to ultimately result in smooth transverse movement of the feed rails 24, 26.

In summary, the tri-axial transfer drive system 28 comprises a conjugate cam system, which provides movement of parallel rails 24, 26 along longitudinal, transverse, and vertical axes. A torque equalizing assembly is provided to ensure smooth, consistent rotation of the cams 40 and the cam shaft 36. A tensioning assembly 150 ensures smooth, consistent operation of the remaining components of the transverse stroke drive system 28. The assembly 150 includes a tensioning sprocket 152, which is driven by an actuator 160 to provide tension on the chain 154 coupled to a shaft 132. An additional spring biased tensioning device 182 maintains tension on the tensioning means 154 to further eliminate slop during operation. The constant tension provided by the chain 154 ensures positive, slip-free meshing of the drive components to yield smooth, consistent motion of the rails 24, 26, during transverse motion.

I claim:

1. In a transfer feed press for performing a series of press operations on a workpiece at a series of work stations, a transfer feed system for moving a workpiece through successive work stations comprising the combination of:

a first and a second transfer feed rail extending longitudinally along opposite sides of a series of work stations, means for independently controlling movement of the first rail and the second rail along a longitudinal axis defining the direction of workpiece movement through the successive work stations of the press, along a transverse axis defining the direction of movement of the rails in and out of engagement with the workpieces at the various work stations, and a vertical axis defining the direction of movement raising and lowering the workpieces, said means for independently controlling movement of the rails including at least one rotatable gear having a driving shaft rotating in a direction for moving at least one of said rails along its respective axis, tensioning means in nondriving relationship with and separate from said movement controlling means including rotatable driving means, coupling means connecting said rotatable driving means to the gear driving shaft, and tension maintaining means associated with the coupling means such that the tensioning means biases the gear driving shaft in a direction opposite to the rotatable direction of the gear driving shaft, whereby the gear is rotated in a smooth motion and the resulting movement of the rails is substantially smooth and controlled.

2. A transfer feed system as claimed in claim 1 wherein the means for independently controlling rail movement comprises a cam system.

3. A transfer feed system as claimed in claim 2 wherein the cam system includes a first cam and cam follower which control movement along the longitudinal axis, a second cam and cam follower which control movement along the transverse axis, and a third cam and cam follower which control movement along the vertical axis.

4. A transfer feed system as claimed in claim 3 wherein the means for controlling movement of the rails along the transverse axis includes a pinion gear disposed on the gear shaft and a set of rack gears which mesh with the pinion gear.

5. A transfer feed system as claimed in claim 1 wherein the gear is a pinion gear and the means for controlling movement further comprises a rack gear in which the pinion gear is mounted for movement.

6. A transfer feed system as claimed in claim 1 further comprising a first sprocket coupled to the gear driving shaft, the tensioning means further including a second sprocket having a shaft disposed in parallel relationship to the gear driving shaft, and the coupling means coupling the sprockets together.

7. In a transfer feed press for performing a series of press operations on a workpiece at a series of work stations, a transfer feed system for moving a workpiece through successive work stations comprising the combination of:

a first and a second transfer feed rail extending longitudinally along opposite sides of a series of work stations, a means for independently controlling movement of the first rail and the second rail along a longitudinal axis defining the direction of workpiece movement through the successive work stations of the press, along a transverse axis defining the direction of movement of the rails in and out of engagement with the workpieces at the various work stations, and a vertical axis defining the direction of movement raising and lowering the workpieces, said means for independently controlling movement of the rails including at least one rotatable gear having a driving shaft, rotatably driving tensioning means, a chain, said chain coupling the rotatably driven tensioning means to the gear driving shaft, and means for maintaining tension on the chain whereby the gear is rotated in a smooth motion so that the resulting movement of the rails is substantially smooth and controlled.

8. In a transfer feed press for performing a series of press operations on a workpiece at a series of work stations, a transfer feed system for moving a workpiece through successive work stations comprising the combination of:

a first and second transfer feed rail extending longitudinally along opposite sides of a series of work stations, means for independently controlling movement of the first rail and the second rail along a longitudinal axis defining the direction of workpiece movement through the successive work stations of the press, along a transverse axis defining the direction of movement of the rails in and out of engagement with the workpieces at the various work stations, and a vertical axis defining the direction of movement raising and lowering the workpieces, said means for independently controlling movement of the rails including at least one rotatable gear having a driving shaft, rotatably driven tensioning means, means for coupling the rotatably driven tensioning means to the gear driving shaft, and means for maintaining tension on the coupling means, said means for maintaining tension includes a sprocket positioned to contact the coupling means, said sprocket being spring biased to exert a force on the coupling means whereby the gear is rotated in a smooth motion so that the resulting movement of the rails is substantially smooth and controlled.

9. In a transfer feed press for performing a series of press operations on a workpiece at a series of work stations, a transfer feed system for moving a workpiece through successive work stations comprising the combination of:

a first and a second transfer feed rail extending longitudinally along opposite sides of a series of work stations, means for independently controlling movement of the first rail and the second rail along a longitudinal axis defining the direction of workpiece movement through the successive work stations of the press, along a transverse axis defining the direction of movement of the rails in and out of engagement with the workpieces at the various work stations, and a vertical axis defining the direction of movement raising and lowering the workpieces, said means for independently controlling movement of the rails including at least one rotatable gear having a driving shaft, a first sprocket coupled to the gear driving shaft, rotatably driven tensioning means including a second sprocket having a shaft disposed in parallel relationship to the gear driving shaft, means for coupling the sprockets together, means for variably adjusting the second sprocket toward or away from the first sprocket to maintain tension on the coupling means whereby the gear is rotated in a smooth motion so that the resulting movement of the rails is substantially smooth and controlled.

10. A transfer feed system as claimed in claim 9 wherein the second sprocket is driven by means of a rotary actuator.

11. A transfer feed system as claimed in claim 9 wherein the means for coupling is a chain.

12. A transfer feed system as claimed in claim 11 wherein the means for maintaining tension includes a third sprocket positioned to contact the means for coupling, said third sprocket being spring-biased to exert a force on the means for coupling.

* * * * *